US008511784B2

(12) United States Patent
Zhang

(10) Patent No.: US 8,511,784 B2
(45) Date of Patent: Aug. 20, 2013

(54) MULTI PLATE LAYERED LIQUID EJECTING HEAD, LIQUID EJECTING HEAD UNIT, AND LIQUID EJECTING APPARATUS

(75) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 100 days.

(21) Appl. No.: 13/180,449

(22) Filed: Jul. 11, 2011

(65) Prior Publication Data

US 2012/0007909 A1 Jan. 12, 2012

(30) Foreign Application Priority Data

Jul. 12, 2010 (JP) ..... 2010-158168

(51) Int. Cl.
*B41J 29/38* (2006.01)

(52) U.S. Cl.
USPC ..... 347/17; 347/68; 347/70

(58) Field of Classification Search
USPC ..... 347/14, 17, 19, 68, 70–72
See application file for complete search history.

(56) References Cited

U.S. PATENT DOCUMENTS

| | | | | |
|---|---|---|---|---|
| 7,293,860 | B2 * | 11/2007 | Sekiguchi | 347/71 |
| 7,328,965 | B2 * | 2/2008 | Owaki | 347/20 |
| 7,344,229 | B2 * | 3/2008 | Ito et al. | 347/71 |
| 7,422,313 | B2 * | 9/2008 | Umeda et al. | 347/68 |
| 2006/0066690 | A1 | 3/2006 | Katayama | |
| 2009/0195622 | A1 | 8/2009 | Okubo | |

FOREIGN PATENT DOCUMENTS

| | | | |
|---|---|---|---|
| JP | 2006/095725 | A | 4/2006 |
| JP | 2009/208461 | A | 9/2009 |

* cited by examiner

*Primary Examiner* — Juanita D Jackson
(74) *Attorney, Agent, or Firm* — Kilpatrick Townsend & Stockton LLP

(57) ABSTRACT

Provided is a liquid ejecting head, a liquid ejecting head unit, and a liquid ejecting apparatus are provided that can secure sufficient compliance in a manifold and prevent degradation in liquid dispensing characteristic. In the liquid ejecting head, a flow path plate including pressure chambers arranged in a row, a manifold plate including a manifold communicating with the pressure chambers, thus constituting a common liquid chamber, a compliance plate that seals the manifold, and a nozzle plate including a nozzle orifice communicating with the pressure chamber so as to eject a liquid, are stacked in this order. The compliance plate includes a flexible compliance portion formed in a region opposing the manifold, and the nozzle plate includes a through hole formed in a region opposing the compliance portion.

7 Claims, 4 Drawing Sheets

MULTI PLATE LAYERED LIQUID EJECTING HEAD, LIQUID EJECTING HEAD UNIT, AND LIQUID EJECTING APPARATUS

BACKGROUND

1. Technical Field

The present invention relates to a liquid ejecting head, a liquid ejecting head unit, and a liquid ejecting apparatus that eject a liquid through a nozzle opening, and more particularly to an ink jet recording head, an ink jet recording head unit, and an ink jet recording apparatus that dispense ink as an example of the liquid.

2. Related Art

Some of currently available ink jet recording heads, examples of the liquid ejecting head, include an actuator unit that includes a piezoelectric element and a pressure chamber, and a flow path unit that includes a nozzle plate with nozzle orifices communicating with a pressure chamber for dispensing ink and a manifold plate including a manifold that serves as a common ink chamber of the pressure chamber.

With reference to such ink jet recording heads, for example JP-A-2006-95725 proposes sealing the manifold with the nozzle plate and utilizing the portion of the nozzle plate sealing the manifold as a compliance portion that can be deformed by pressure fluctuation inside the manifold.

Also, for example JP-A-2009-208461 proposes providing a compliance plate that includes the compliance portion that can be deformed by pressure fluctuation inside the manifold, on a bottom face of the manifold plate.

In the latter case, the compliance plate includes a recess where the thickness of the compliance plate is reduced, and such a recess serves as the compliance portion.

However, in the case where the compliance portion is formed on the nozzle plate as JP-A-2006-95725, vibration of the compliance portion directly propagates to the vicinity of the nozzle orifice, thereby affecting the dispensing direction or dispensing characteristic of the recording head. Also, the nozzle plate cannot be made thinner because the nozzle orifices have to be formed therethrough, while it is preferable to make the compliance plate thinner in order to secure flexibility of the compliance portion. Thus, it is difficult to sufficiently realize both the function of a nozzle plate and the function of a compliance plate, with a single substrate.

Also, sufficient space that allows deformation of the compliance portion cannot be secured by simply forming the recess on the compliance plate as the compliance portion as JP-A-2009-208461, and hence the compliance portion cannot fully absorb the pressure fluctuation inside the manifold, which results in a degraded ink dispensing characteristic. The compliance plate has to have a certain thickness for forming the recess, and hence a communication channel (flow path) from the pressure chamber to the nozzle orifice becomes long, which makes the ink dispensing characteristic disadvantageous for high-frequency driving.

SUMMARY

An advantage of some aspects of the invention is that a liquid ejecting head, a liquid ejecting head unit, and a liquid ejecting apparatus are provided that can secure sufficient compliance in a manifold and prevent degradation of a liquid dispensing characteristic.

In one aspect, the invention provides a liquid ejecting head including a flow path plate including a plurality of pressure chambers arranged in a row; a manifold plate including a manifold communicating with the pressure chambers, thus constituting a common liquid chamber; a compliance plate that seals the manifold; and a nozzle plate including a nozzle orifice communicating with the pressure chamber so as to eject a liquid; the flow path plate, the manifold plate, the compliance plate, and the nozzle plate being stacked in this order. The compliance plate includes a flexible compliance portion formed in a region opposing the manifold, and the nozzle plate includes a through hole formed in a region opposing the compliance portion.

In the foregoing liquid ejecting head, the compliance plate and the nozzle plate are independently formed components. Such a configuration suppresses propagation of vibration of the compliance plate to the nozzle orifices, thereby preventing the liquid drop dispensing direction and dispensing characteristic from being unfavorably affected. Also, the compliance plate can be made relatively thinner, and hence a distance between the pressure chamber and the nozzle orifice can be reduced and a liquid dispensing characteristic can be improved. Besides, the through hole eliminates limitation to amount of deformation of the compliance portion, thereby allowing pressure fluctuation inside the manifold to be sufficiently absorbed by the compliance portion.

Preferably, the nozzle plate may be formed of a silicon substrate or a metal plate. Such materials allow the nozzle orifice to be formed with high accuracy.

It is also preferable that the nozzle plate includes, on the side of a liquid ejecting face thereof, a cover head including a nozzle exposure opening through which the nozzle orifice can be exposed. In this case, the cover plate protects the nozzle plate thereby preventing deformation or breakdown thereof.

In another aspect, the present invention provides a liquid ejecting head unit including a plurality of liquid ejecting heads configured as above.

Such a configuration contributes to improving the liquid ejecting characteristic of the liquid ejecting head unit.

In still another aspect, the present invention provides a liquid ejecting apparatus including the foregoing liquid ejecting head unit or the liquid ejecting head.

Such a configuration contributes to improving the liquid ejecting characteristic of the liquid ejecting apparatus.

Preferably, the liquid ejecting apparatus may further include a temperature detector that detects ambient temperature, and a control unit that compensates, on the basis of the ambient temperature detected by the temperature detector, a driving signal for driving a pressure generator that applies pressure fluctuation to the liquid in the pressure chamber.

Such an arrangement enables acquisition of information indicating an actual temperature of the liquid in the liquid ejecting head, by measuring the ambient temperature instead of detecting the actual temperature of the liquid in the liquid ejecting head, thereby allowing the liquid ejecting apparatus to dispense the liquid on the basis of driving signals appropriate for the actual temperature of the liquid. Therefore, fluctuation of the liquid dispensing characteristic arising from temperature fluctuation can be suppressed, and printing quality can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
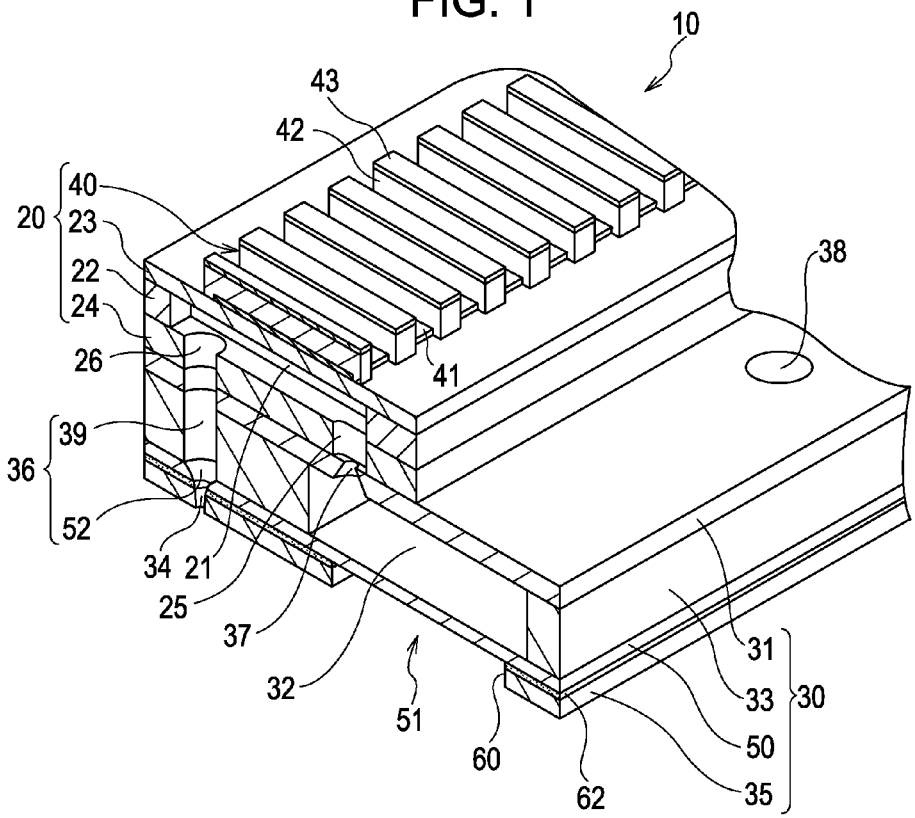
FIG. 1 is a partially cut away perspective view showing a recording head according to an embodiment of the present invention.

Hereafter, embodiments of the invention will be described, referring to the drawings.

First Embodiment

Figure 2:
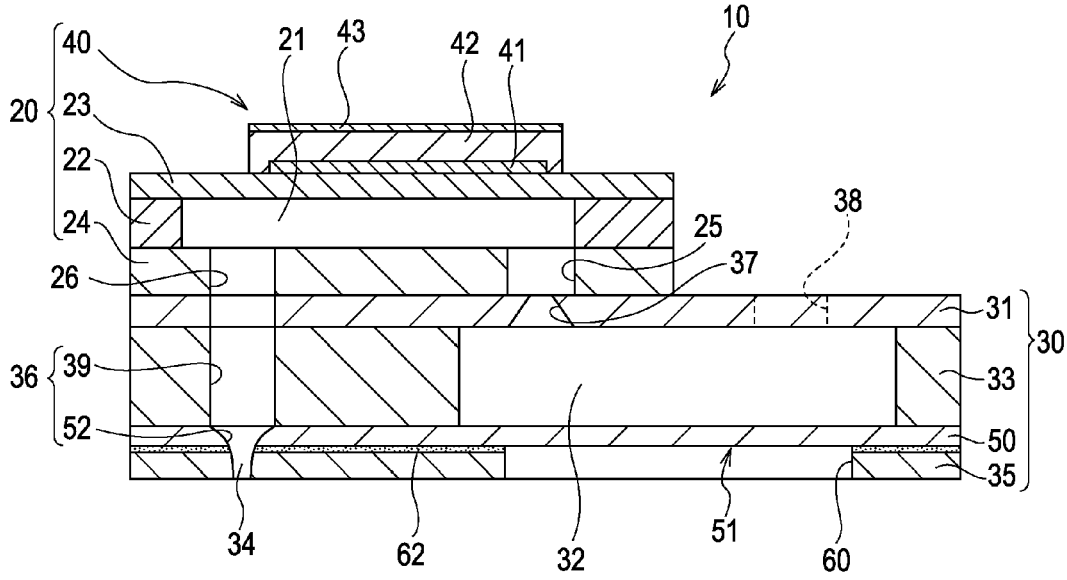
FIG. 2 is a cross-sectional view of the recording head according to the embodiment of the present invention.
Figure 3:
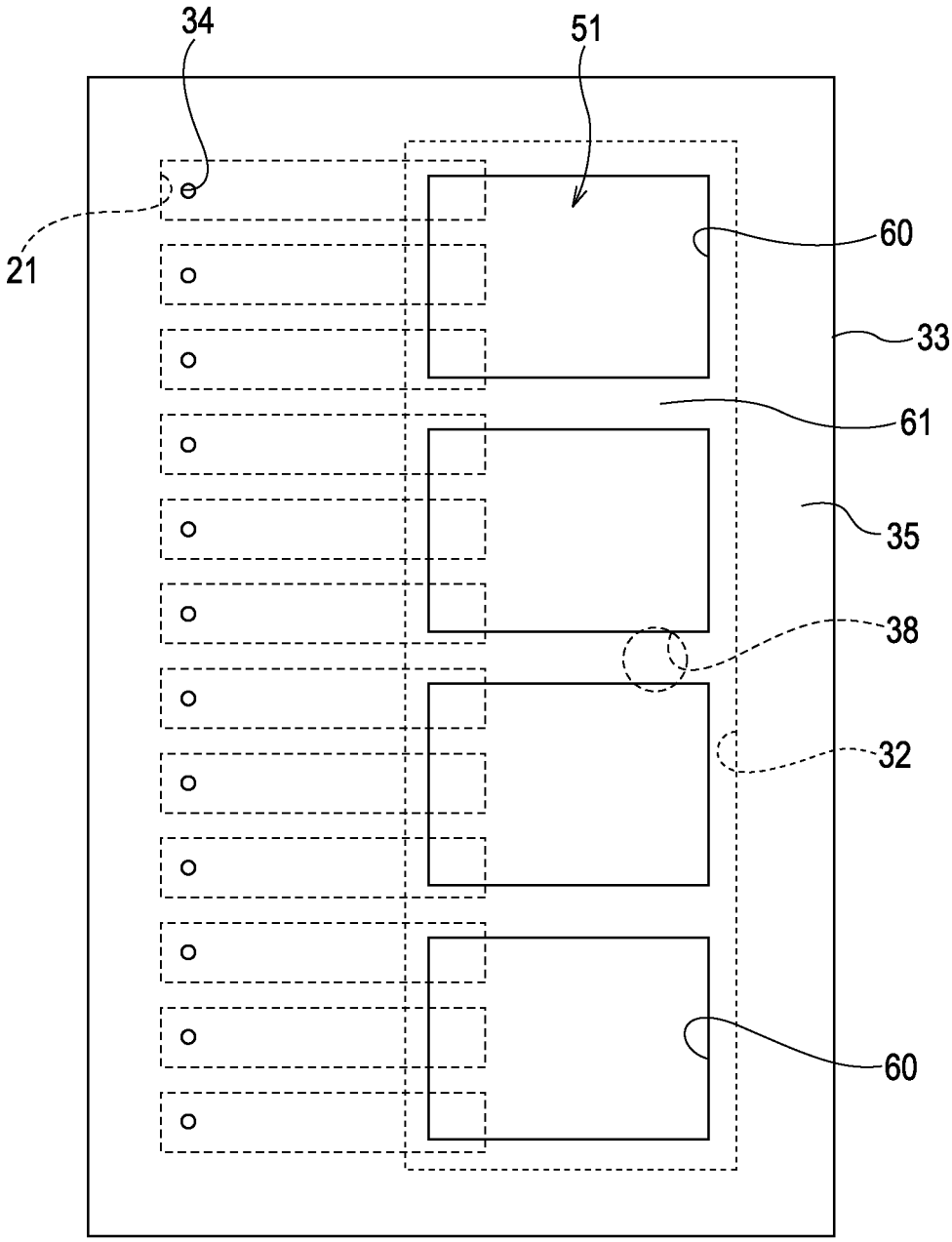
FIG. 3 is a fragmentary plan view of the recording head according to the embodiment of the present invention.

FIG. 1 is a partially cut away perspective view showing an ink jet recording head, exemplifying the liquid ejecting head according to the first embodiment of the present invention; FIG. 2 is a cross-sectional view of the ink jet recording head; and FIG. 3 is a fragmentary plan view of the ink jet recording head.

As shown in these drawings, an ink jet recording head 10 according to this embodiment includes an actuator unit 20, and a flow path unit 30 on which the actuator unit 20 is fixed.

The actuator unit 20 includes a piezoelectric element 40, a flow path plate 22 including pressure chambers 21, a vibrating plate 23 provided on a face of the flow path plate 22, and a pressure chamber bottom plate 24 provided on the opposite face of the flow path plate 22.

The flow path plate 22 is composed, for example, of a ceramic such as alumina ($Al_2O_3$) or zirconia ($ZrO_2$) having a thickness of approx. 150 μm, and in this embodiment a plurality of pressure chambers 21 are aligned in a widthwise direction thereof. The vibrating plate 23, which is formed of a stainless steel plate of 10 to 12 μm in thickness for example, is fixed to one of the faces of the flow path plate 22, such that one side of the pressure chambers 21 is covered with the vibrating plate 23.

The pressure chamber bottom plate 24 is fixed to the other face of the flow path plate 22 opposite the vibrating plate 23, so as to cover the opposite side of the pressure chambers 21, and includes supply paths 25 each formed close to a longitudinal end portion of the pressure chamber 21 for communication between the pressure chamber 21 and a manifold to be subsequently described, and nozzle communication paths 26 each formed close to the other longitudinal end portion of the pressure chamber 21 for communicating with a nozzle orifice 34 to be subsequently described.

The piezoelectric elements 40 are provided on the vibrating plate 23 at positions respectively opposing the pressure chambers 21.

The piezoelectric elements 40 each include a lower electrode layer 41 located on the vibrating plate 23, a piezoelectric layer 42 independently associated with each of the pressure chambers 21, and an upper electrode layer 43 provided on the piezoelectric layer 42. The piezoelectric layer 42 may be formed by attaching a green sheet made of a piezoelectric material, or by a printing process. The lower electrode layer 41 is disposed so as to span over the aligned piezoelectric layers 42 so as to constitute a common electrode for the piezoelectric elements 40, and thus serves as a part of the vibrating plate 23. Alternatively, the lower electrode layer 41 may be independently provided for each of the piezoelectric layers 42.

The flow path plate 22, the vibrating plate 23, and the pressure chamber bottom plate 24 constituting the actuator unit 20 can be formed into a unified piece without the need to use an adhesive, by molding a ceramic material in a clay state, what is known as a green sheet, into plates of a predetermined thickness, forming for example the pressure chambers 21 in one of the plates, and stacking the plates and sintering. Thereafter, the piezoelectric elements 40 can be formed on the vibrating plate 23.

The flow path unit 30 includes a liquid outlet plate 31 attached to the pressure chamber bottom plate 24 of the actuator unit 20, a manifold plate 33 including a manifold 32 that serves as a common ink chamber for the plurality of pressure chambers 21, a compliance plate 50 provided on the manifold plate 33 so as to oppose the liquid outlet plate 31, and a nozzle plate 35 including a plurality of nozzle orifices 34.

The liquid outlet plate 31 is formed of a stainless steel plate having a thickness of 60 μm, and is perforated with nozzle communication paths 36 each serving for communication between the nozzle orifice 34 and the pressure chamber 21, liquid outlets 37 each connected to the supply path 25 for communication between the manifold 32 and the pressure chamber 21, and a liquid inlet 38 communicating with the manifold 32 for introducing ink from an external ink tank. The liquid outlets 37 and the liquid inlet 38 are located so as to communicate with the respective end portions of the manifold 32 in the longitudinal direction of the pressure chambers 21, in other words in a direction orthogonal to the direction in which the pressure chambers 21 are aligned. In this embodiment, the single liquid inlet 38 is located so as to communicate with a central portion of the manifold 32 in the direction in which the pressure chambers 21 are aligned.

The manifold plate 33 is formed of a corrosion resistant plate suitable for forming an ink flow path (liquid channel), such as a stainless steel plate of 150 μm in thickness, and includes the manifold 32 that receives ink from an external ink tank (not shown) and supplies the ink to the pressure chambers 21, and nozzle communication paths 39 each allowing communication between the pressure chamber 21 and the nozzle orifice 34.

The manifold 32 is formed so as to extend along the plurality of pressure chambers 21, in other words in the direction in which the pressure chambers 21 are aligned.

The compliance plate 50 is attached to the side of the manifold plate 33 opposite the liquid outlet plate 31, so as to cover the bottom face of the manifold 32. The compliance plate 50 may be composed of a metal such as stainless steel, a resin such as polyphenylene sulfide (PPS), a ceramic, or a multilayer structure of these, and it is preferable that at least a portion covering the manifold 32 is flexible. In this embodiment, a stainless steel plate of 12 μm in thickness is employed as the compliance plate 50. Here, the multilayer structure of the compliance plate 50 refers to, for example, a structure formed of an elastic film and a supporting substrate a portion of which is perforated in a thickness direction.

The compliance plate 50 also includes nozzle communication paths 52 each perforated in the thickness direction so as to allow communication between the nozzle communication path 39 formed in the manifold plate 33 and the nozzle orifice 34. Thus, the ink from the pressure chamber 21 is dispensed from the nozzle orifice 34 through the nozzle communication paths 36, 39, and 52 provided in the liquid outlet plate 31, the manifold plate 33, and the compliance plate 50, respectively.

Although the compliance plate 50 is formed in a uniform thickness in this embodiment, for example only a portion thereof covering the manifold 32 may be formed in a reduced thickness compared with the remaining portion. However, the compliance plate 50 includes the nozzle communication paths 52 perforated in the thickness direction so as to allow communication between the nozzle communication paths 39 formed in the manifold plate 33 and the nozzle orifices 34. Accordingly, in the case where only the portion of the compliance plate 50 covering the manifold 32 is made thinner, the nozzle communication path 52 becomes longer and the distance between the nozzle orifice 34 and the pressure chamber 21 is increased, which is undesirable. For example, an increase in distance between the nozzle orifice 34 and the pressure chamber 21 leads to an increase in flow path resistance for example, thereby degrading the ink dispensing characteristic.

The nozzle plate 35 is composed, for example, of a plate material made of a metal such as stainless steel or a ceramic such as silicon. The nozzle plate 35 is perforated with the nozzle orifices 34 at the same pitch as that of the pressure chambers 21.

The nozzle plate 35 also includes through holes 60 formed in a thickness direction, in a region opposing the manifold 32. Accordingly, the region of the compliance plate 50 exposed through the through holes 60 serves as a compliance portion 51. Thus, the nozzle plate 35 can also be described as including the through holes 60 formed in a thickness direction, in the region opposing the compliance portion 51.

In this embodiment, the through holes 60 are disposed so as to be partioned, as shown in FIG. 3, in the direction in which the pressure chambers 21 are aligned, so as to be each associated with a corresponding pressure chamber group consisting of a plurality of pressure chambers 21. In this embodiment, the through holes 60 are provided in four partioned locations in the longitudinal direction of the manifold 32, and hence beam portions 61 are formed integrally with the nozzle plate 35, between the adjacent through holes 60. The beam portions 61 contribute to improving the rigidity of the nozzle plate 35 as a whole, thereby suppressing deformation of the nozzle plate 35, as well as degradation of the ink dispensing characteristic arising from vibration of a portion close to the nozzle orifice 34.

Here, since the nozzle plate 35 has to have certain rigidity in the vicinity of the nozzle orifices 34, it is difficult to reduce the thickness. In this embodiment, the nozzle plate 35 is composed of a stainless steel plate of 60 μm in thickness. Accordingly, it is impossible to close the manifold 32 with a portion of the nozzle plate 35 where the through hole 60 is not provided, and to utilize the portion of the nozzle plate 35 covering the manifold 32 as the compliance portion, instead of providing the compliance plate 50. Since the compliance portion 51 has to be flexible, the compliance portion 51 cannot be made thicker. Therefore, a portion of the nozzle plate 35 cannot be utilized as the compliance portion.

The flow path unit 30 configured as above can be formed by fixing the liquid outlet plate 31, the manifold plate 33, the compliance plate 50, and the nozzle plate 35 with an adhesive or a hot-melt film. Here, although FIG. 2 only shows an adhesive 62 that combines the nozzle plate 35 and the compliance plate 50, an adhesive is also provided between other layers constituting the flow path unit 30. Further, the flow path unit 30 thus formed and the actuator unit 20 are bonded with an adhesive or a hot-melt film, and fixed to each other.

Now, in the ink jet recording head 10 thus configured, the ink is introduced into the manifold 32 from a cartridge (reservoir). After filling the ink flow path from the manifold 32 to the nozzle orifice 34 with the, upon applying a voltage to the piezoelectric elements 40 respectively associated with each of the pressure chambers 21 in accordance with recording signals from a driving circuit (not shown) thereby distortionally deforming the vibrating plate 23 together with the piezoelectric element 40, pressure in each pressure chamber 21 is increased and an ink droplet is ejected from each nozzle orifice 34.

Also, pressure fluctuation generated while the ink is introduced into the manifold 32, and pressure fluctuation in the opposite direction from the nozzle orifice 34 toward the manifold 32 caused when the ink is dispensed from the nozzle orifices 34, can be absorbed by the compliance portion 51 of the compliance plate 50 defined by the through hole 60 of the nozzle plate 35. In this process, since the compliance plate 50 is independent from the nozzle plate 35 according to this embodiment, vibration of the compliance plate 50 is suppressed from propagating to the nozzle orifices 34, and therefore the dispensing direction and dispensing characteristic of the ink droplets can be prevented from being degraded. Also, independently forming the compliance plate 50 and the nozzle plate 35 allows the compliance plate 50 to be made relatively thin, thereby reducing the distance between the pressure chamber 21 and the nozzle orifice 34, which contributes to improving the ink dispensing characteristic. Further, the through hole 60 eliminates restriction on the extent of deformation of the compliance portion 51, and therefore the compliance portion 51 can fully absorb the pressure fluctuation inside the manifold 32.

Further, since the compliance portion 51 is exposed through the through hole 60 provided in the nozzle plate 35, a temperature of the ink inside the ink jet recording head 10, particularly the ink located in a portion of the manifold 32 close to the pressure chamber 21, can be made approximately the same as an external temperature (ambient temperature) in a short time. Here, viscosity of the ink varies depending on the temperature thereof. For example, the viscosity of the ink becomes lower at a higher temperature, and higher at a lower temperature. Accordingly, driving the piezoelectric elements 40 with a driving waveform suitable for the ink temperature (viscosity) for dispensing the ink enables stabilization of the ink dispensing characteristic. In this relation, the ink temperature is normally acquired by measuring the ambient temperature (room temperature) of the ink jet recording head 10 with a temperature detector such as a thermo sensor. In the case where an actual temperature of the ink in the flow path of the ink jet recording head 10 is different from the ambient temperature, the ink cannot be dispensed with the driving waveform appropriate for the actual ink temperature, which results in degraded ink dispensing characteristic. In this embodiment, the through hole 60 of the nozzle plate 35 allows the compliance portion 51 covering the manifold 32 to be outwardly exposed, and hence the temperature of the ink in the manifold 32 can be adjusted to generally the same level as the ambient temperature to be measured, in a short time. Since the ink in the manifold 32 is isolated from outside not by the nozzle plate 35 which is relatively thick, but only by the compliance plate 50 which is relatively thin, the temperature of the ink in the manifold 32 can be adjusted to the ambient temperature in a short time. Therefore, simply measuring the ambient temperature and determining the driving waveform accordingly allows the piezoelectric elements 40 to be driven with the driving waveform suitable for the actual temperature of the ink in the flow path, thereby improving the ink dispensing characteristic.

Additional Embodiments

Figure 4A:
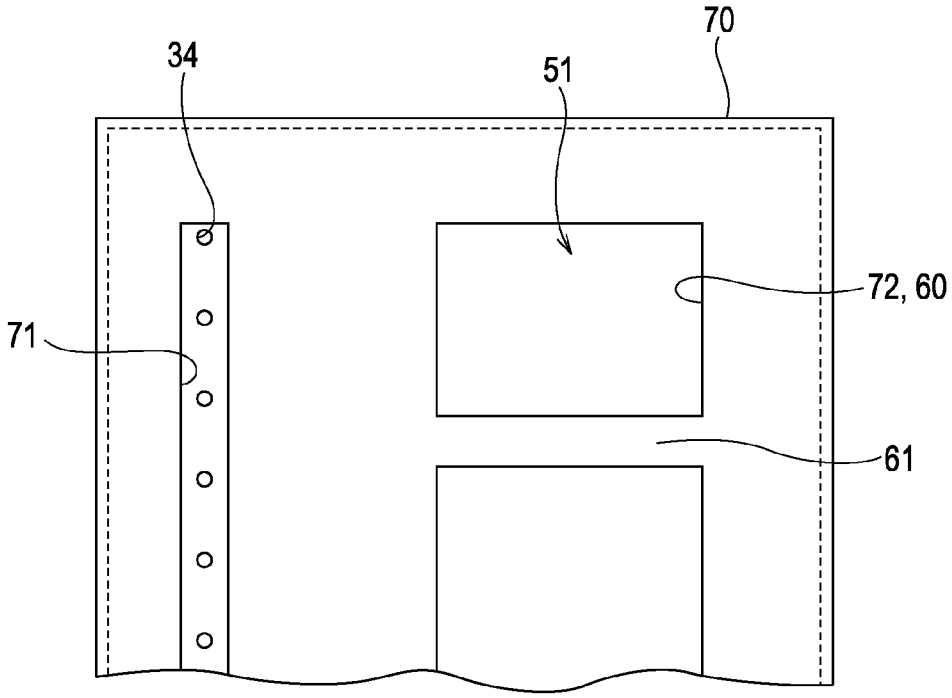
FIGS. 4A and 4B are a fragmentary plan view and a cross-sectional view, respectively, of a recording head according to another embodiment of the present invention.
Figure 4B:
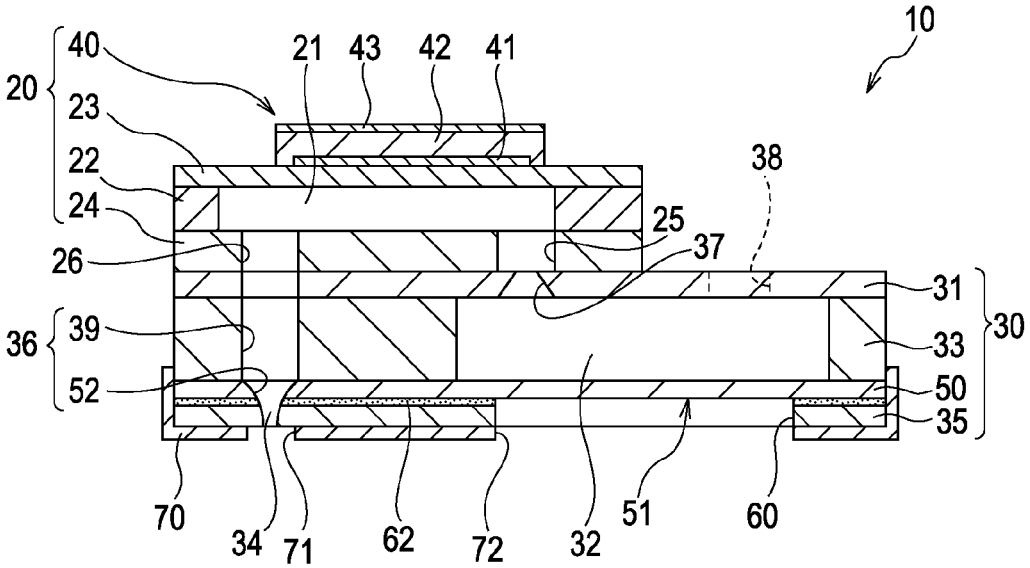

Although the invention has been described with reference to the foregoing embodiments, the structure of the invention is in no way limited to those embodiments. For example, although the first embodiment refers to the case where the nozzle plate 35 is not provided with a cover plate on the opposite side of the compliance plate 50, the cover plate may be provided on the outer side of the nozzle plate 35, i.e., opposite the compliance plate 50. FIGS. 4A and 4B depict such an example. Here, FIGS. 4A and 4B are a fragmentary plan view and a cross-sectional view, respectively, of a recording head according to a different embodiment of the present invention.

As shown therein, the ink jet recording head 10 includes a cover plate 70 that covers the surface of the nozzle plate 35. The cover plate 70 includes a nozzle exposure opening 71 for exposing the plurality of nozzle orifices 34. The cover plate 70 also includes a compliance portion exposure opening 72 communicating with the through hole 60 of the nozzle plate 35 so as to expose the compliance portion 51. Since sufficient space can be secured between the compliance portion 51 and the cover plate 70 by the through hole 60 of the nozzle plate 35, the deformation of the compliance portion 51 is not restricted at all even though the compliance portion exposure opening 72 is not provided in the cover plate 70. However, providing the compliance portion exposure opening 72 in the cover plate 70 makes it easier for the temperature of the ink in the manifold 32 to be adjusted to the ambient temperature through the compliance portion 51, in addition to securing sufficient space for larger deformation of the compliance portion 51.

Also, the ink jet recording head 10 according to the first embodiment includes thick film piezoelectric elements 40, however a different pressure generator may be employed for causing pressure fluctuation in the pressure chambers 21, for example a thin film piezoelectric element that includes a piezoelectric material manufactured by a sol-gel method, MOD method, or sputtering, a vertical vibration type piezoelectric element including a piezoelectric material and an electrode material alternately layered for axially stretching and contracting, what is known as static actuator including a vibrating plate and an electrode disposed with a predetermined gap therebetween, so as to control the vibration of the vibrating plate with static electricity, and an ink jet recording head in which a heating element is provided in the pressure chamber so that a liquid droplet is dispensed from the nozzle orifice by bubbles created by the heat of the heating element, all of which provide the same advantageous effects.

Figure 5:
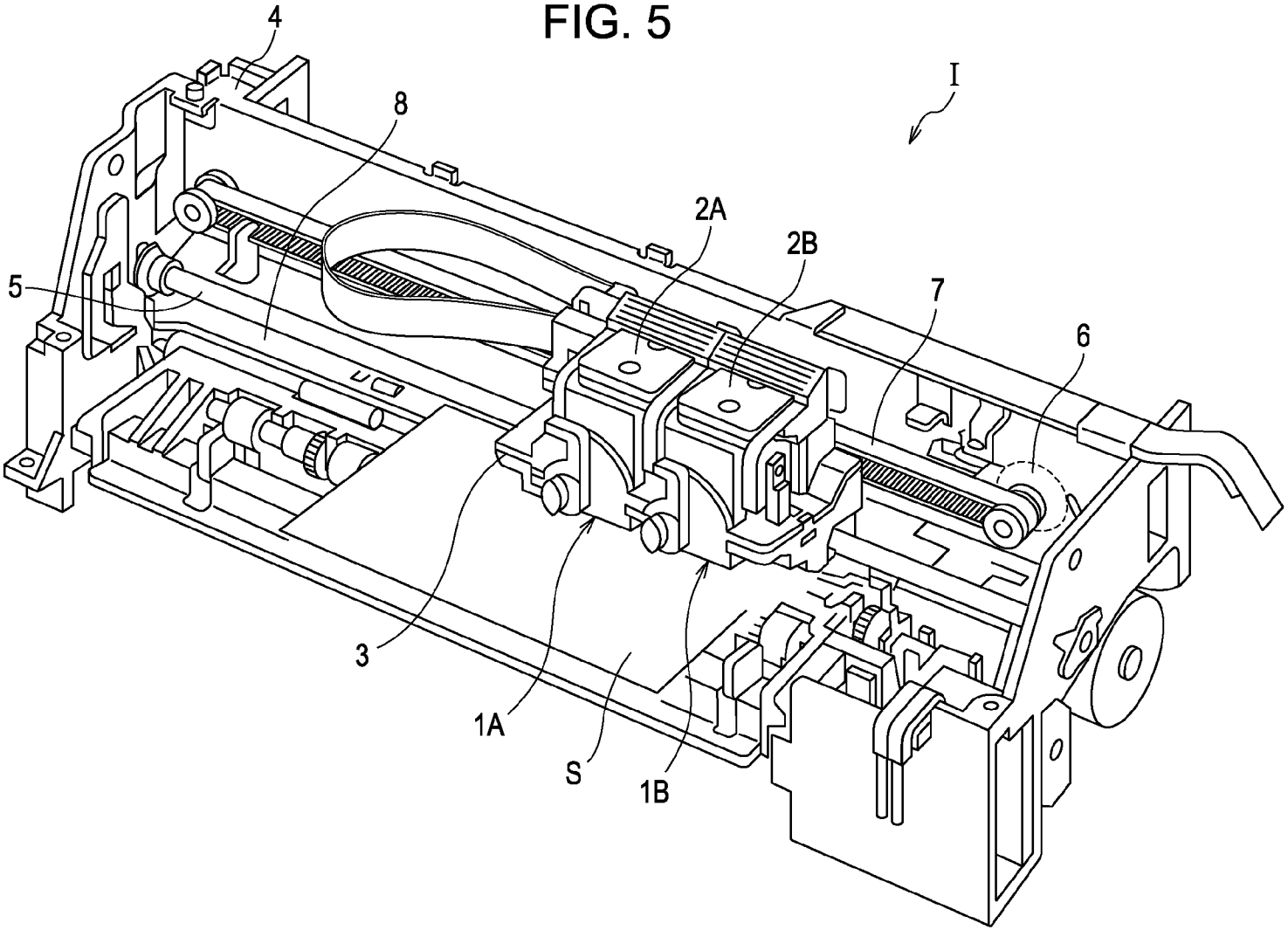
FIG. 5 is a schematic perspective view showing an ink jet recording apparatus according to an embodiment of the present invention.

Further, the ink jet recording head according to this embodiment can constitute a part of a recording head unit including an ink flow path communicating with an ink cartridge or the like, and be incorporated in an ink jet recording apparatus. FIG. 5 is a schematic perspective view showing such an ink jet recording apparatus.

As shown in FIG. 5, the ink jet recording apparatus I includes the recording head units 1A and 1B including the ink jet recording head 10. The head units 1A and 1B include detachable cartridges 2A and 2B serving as the ink supplier, and a carriage 3 with the head units 1A and 1B mounted thereon is provided so as to axially move along a carriage shaft 5 mounted in the apparatus main body 4. The head units 1A and 1B are configured to dispense, for example, a black ink composition and color ink composition.

When a driving force of a driving motor 6 is transmitted to the carriage 3 through a plurality of gears (not shown) and a timing belt 7, the carriage 3 with the recording head units 1A and 1B mounted thereon is caused to move along the carriage shaft 5. The main body 4 includes a platen 8 provided along the carriage shaft 5, so that a recording sheet S, a recording medium such as paper supplied by a feed roller (not shown), is transported on the platen 8. Although not shown, a temperature detector such as a thermo sensor may be provided inside or outside of the main body 4, for measuring the room temperature, an example of the ambient temperature.

The driving motor 6 and the pressure generator of the recording head unit 1A and 1B are controlled and driven by a control unit including a CPU and memories (not shown). Also, the control unit compensates the driving signals to be applied to the piezoelectric elements 40, corresponding to the pressure generator of the ink jet recording head 10, to driving signals suitable for the ambient temperature, on the basis of the ambient temperature detected by the temperature detector. In this process, as already described, since the nozzle plate 35 includes the through hole 60 that allows the compliance portion 51 covering the manifold 32 to be outwardly exposed, the temperature of the ink in the manifold 32 can be adjusted to the ambient temperature being detected, in a short time. Therefore, simply measuring the ambient temperature and compensating the driving waveform, which is the driving signal, allows the piezoelectric elements 40 to be driven with the driving signal (driving waveform) suitable for the actual temperature of the ink in the flow path, thereby improving the ink dispensing characteristic.

Although the foregoing embodiments refer to the ink jet recording head as an example of the liquid ejecting head, the invention is broadly applicable to various liquid ejecting heads, which naturally include those that eject a liquid other than the ink. Examples of such liquid ejecting head include a recording head for use in an image recording apparatus such as a printer, a color material ejecting head employed for manufacturing a color filter for an LCD and the like, an electrode material ejecting head employed for manufacturing an electrode in an organic EL display or a field discharge display (FED), and an bioorganic ejecting head for manufacturing a biochip.

The entire disclosure of Japanese Patent Application No. 2010-158168, filed Jul. 12, 2010 is expressly incorporated by reference herein.

What is claimed is:

1. A liquid ejecting head comprising:

a flow path plate including a pressure chamber communicating with a nozzle orifice that ejects a liquid, the flow path plate having thereon a pressure generator that causes pressure fluctuation in the liquid in the nozzle orifice and the pressure chamber;

a manifold plate including a manifold communicating with the pressure chamber, thus constituting a common liquid chamber;

a compliance plate that seals the manifold; and a nozzle plate communicating with the pressure chamber and including the nozzle orifice;

the flow path plate, the manifold plate, the compliance plate, and the nozzle plate being stacked in this order and the compliance plate adhere directly to the nozzle plate;

wherein the compliance plate includes a passively flexible compliance portion formed in a region opposing the manifold; and the nozzle plate includes a through hole formed in a region opposing the compliance portion.

2. The liquid ejecting head according to claim 1, wherein the nozzle plate is composed of a silicon substrate or a metal plate.

3. The liquid ejecting head according to claim 1, wherein the nozzle plate includes, on the side of a liquid ejecting face thereof, a cover head including a nozzle exposure opening through which the nozzle orifice can be exposed.

4. A liquid ejecting head unit comprising a plurality of liquid ejecting heads according to claim 1.

5. A liquid ejecting apparatus comprising the liquid ejecting head unit according to claim 4.

6. A liquid ejecting apparatus comprising the liquid ejecting head according to claim 1.

7. The liquid ejecting apparatus according to claim 6, further comprising:

a temperature detector located in an area such that it detects the ambient temperature near the recording head; and a control unit communicably connected to a pressure generator that compensates, on the basis of the ambient temperature detected by the temperature detector, a driving signal for driving the pressure generator that causes pressure fluctuation in the liquid in the pressure chamber.

* * * * *